US007497685B2

(12) United States Patent
Kubicek et al.

(10) Patent No.: US 7,497,685 B2
(45) Date of Patent: Mar. 3, 2009

(54) WICK-HOLDER ASSEMBLY

(75) Inventors: Chris A. Kubicek, East Troy, WI (US); Cory J Nelson, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 504 days.

(21) Appl. No.: 11/185,174

(22) Filed: Jul. 20, 2005

(65) Prior Publication Data

US 2007/0020574 A1 Jan. 25, 2007

(51) Int. Cl.
*F23D 13/34* (2006.01)

(52) U.S. Cl. ..... 431/298; 431/34; 431/102; 431/282; 431/288; 431/292; 362/161; 362/190; 362/447; 362/382; 362/433

(58) Field of Classification Search ..... 431/298, 431/34, 102, 282, 288, 292, 308, 289, 75, 431/290, 301, 325, 306, 320, 206, 35, 293; 362/161, 190, 447, 382, 433
See application file for complete search history.

(56) References Cited

U.S. PATENT DOCUMENTS

| | | | |
|---|---|---|---|
| 213,184 | A | 3/1879 | Frick |
| 405,786 | A | 6/1889 | Ludde |
| 407,051 | A | 7/1889 | Baumer |
| 408,973 | A | 8/1889 | Heller |
| 484,210 | A | 10/1892 | Ludde |
| 779,644 | A | 1/1905 | Ferrier |
| 837,240 | A | 11/1906 | Mulkerins |
| 1,044,256 | A | 11/1912 | Satter |
| D43,845 | S | 4/1913 | Hirschfeld |
| 1,195,657 | A | 8/1916 | Chersky |
| D49,902 | S | 11/1916 | Labaree et al. |
| 1,229,140 | A | 6/1917 | Ritter |
| 1,316,624 | A | 9/1919 | Lucas |
| 1,320,109 | A | 10/1919 | Wooster |
| 1,336,635 | A | 4/1920 | Knapp |
| 1,390,389 | A | 9/1921 | Rosenfeld |
| 1,484,964 | A | 2/1924 | Benneville |
| D67,108 | S | 4/1925 | Steeple |
| 1,640,734 | A | 8/1927 | Smith |
| D75,463 | S | 6/1928 | Bach |
| D80,971 | S | 4/1930 | Sakier |

(Continued)

FOREIGN PATENT DOCUMENTS

| | | |
|---|---|---|
| CA | 2208145 | 12/1998 |

(Continued)

OTHER PUBLICATIONS

International Candle House catalog (1966-67); Bobeshes pp. 54-55.

(Continued)

*Primary Examiner*—Steven B McAllister
*Assistant Examiner*—Avinash Savani

(57) ABSTRACT

A wick-holder assembly includes a wick-retention member for retaining a wick thereto and a heat-conductive element extending from a base portion. The heat-conductive element may include materials having different thermal expansion coefficients. The materials may be arranged to interact to cause a portion of the heat-conductive element to move in response to a flame disposed on the wick.

6 Claims, 4 Drawing Sheets

U.S. PATENT DOCUMENTS

| | | | | |
|---|---|---|---|---|
| D83,100 | S | | 1/1931 | Gisolfi |
| D110,902 | S | | 8/1938 | Loesch |
| D119,587 | S | | 3/1940 | Fuerst |
| 2,234,903 | A | | 3/1941 | Muench |
| 2,237,523 | A | | 4/1941 | Damon |
| 2,246,346 | A | | 6/1941 | Wells |
| 2,254,906 | A | | 9/1941 | Petrulis |
| 2,324,753 | A | | 7/1943 | Alexiade |
| 2,354,343 | A | | 7/1944 | Webber et al. |
| 2,393,767 | A | | 1/1946 | Gould |
| 2,462,440 | A | | 2/1949 | Tierney |
| 2,494,995 | A | | 1/1950 | Gardner |
| 2,713,256 | A | | 7/1955 | Oesterle |
| 2,758,460 | A | | 8/1956 | Ciano |
| 2,775,006 | A | | 12/1956 | Kranc |
| 2,809,512 | A | | 10/1957 | Hartnett |
| RE24,423 | E | | 2/1958 | Oesterle et al. |
| 3,121,316 | A | | 2/1964 | Wilson |
| D206,946 | S | | 2/1967 | Knodt |
| D208,064 | S | | 7/1967 | Quistgaard et al. |
| D208,097 | S | | 7/1967 | Henn |
| 3,565,281 | A | | 2/1971 | Collie |
| D226,240 | S | | 1/1973 | Twedt |
| 3,730,674 | A | | 5/1973 | Gross |
| 3,741,711 | A | | 6/1973 | Bryant |
| 3,749,904 | A | | 7/1973 | Graff |
| 3,762,857 | A | | 10/1973 | Andeweg |
| D229,852 | S | | 1/1974 | Lindblad |
| D236,064 | S | | 7/1975 | Balbo |
| 3,898,039 | A | | 8/1975 | Lin |
| 3,910,753 | A | | 10/1975 | Lee |
| 3,932,113 | A | | 1/1976 | Thrush |
| 3,994,502 | A | | 11/1976 | Lombardi |
| 4,013,397 | A | | 3/1977 | Neugart |
| 4,019,856 | A | | 4/1977 | Lacroix |
| D247,635 | S | | 3/1978 | Maxwell |
| D248,499 | S | | 7/1978 | Ulrich et al. |
| D248,500 | S | | 7/1978 | Ulrich et al. |
| 4,102,634 | A | | 7/1978 | Crisp |
| D248,787 | S | | 8/1978 | Ulrich et al. |
| D248,788 | S | | 8/1978 | Ulrich et al. |
| D248,789 | S | | 8/1978 | Ulrich et al. |
| D253,432 | S | | 11/1979 | Van Koert |
| D253,732 | S | | 12/1979 | Van Koert |
| 4,185,953 | A | * | 1/1980 | Schirneker ..... 431/291 |
| 4,206,500 | A | | 6/1980 | Neil |
| 4,206,560 | A | | 6/1980 | Sefried, II |
| 4,224,017 | A | | 9/1980 | Kayne |
| D264,385 | S | | 5/1982 | Meyer |
| 4,332,548 | A | | 6/1982 | Linton et al. |
| 4,381,914 | A | | 5/1983 | Ferguson |
| 4,427,366 | A | | 1/1984 | Moore |
| 4,477,249 | A | | 10/1984 | Ruzek et al. |
| 4,524,408 | A | | 6/1985 | Minera |
| 4,551,794 | A | | 11/1985 | Sandell |
| 4,557,687 | A | | 12/1985 | Schirneker |
| 4,568,269 | A | | 2/1986 | Lin |
| 4,568,270 | A | | 2/1986 | Marcus et al. |
| 4,588,618 | A | | 5/1986 | Wolfe |
| D292,525 | S | | 10/1987 | Van Deelen |
| 4,755,135 | A | | 7/1988 | Kwok |
| 4,781,895 | A | | 11/1988 | Spector |
| 4,804,323 | A | | 2/1989 | Kim |
| D312,507 | S | | 11/1990 | Thoreson |
| 4,983,119 | A | | 1/1991 | Lin |
| 4,999,947 | A | * | 3/1991 | Whitaker ..... 47/81 |
| 5,015,175 | A | | 5/1991 | Lee |
| D320,266 | S | | 9/1991 | Kunze |
| 5,069,617 | A | | 12/1991 | Lin |
| 5,078,591 | A | * | 1/1992 | Despres ..... 431/75 |
| 5,078,945 | A | | 1/1992 | Byron |
| 5,086,380 | A | | 2/1992 | Hedner, Jr. |
| D325,077 | S | | 3/1992 | Kearnes |
| 5,101,328 | A | | 3/1992 | Hai |
| 5,174,645 | A | | 12/1992 | Chung |
| 5,193,995 | A | | 3/1993 | Keller et al. |
| 5,338,187 | A | | 8/1994 | Elharar |
| 5,363,590 | A | | 11/1994 | Lee |
| D355,266 | S | | 2/1995 | Caplette et al. |
| D356,472 | S | | 3/1995 | Jaworski |
| 5,425,633 | A | | 6/1995 | Cole |
| D360,461 | S | | 7/1995 | Gillespie |
| D369,871 | S | | 5/1996 | Lui |
| D371,212 | S | | 6/1996 | Hardy et al. |
| D376,002 | S | | 11/1996 | Upson |
| D377,402 | S | | 1/1997 | Perkins |
| D383,944 | S | | 9/1997 | Lillelund et al. |
| 5,690,484 | A | | 11/1997 | Leonard et al. |
| D390,676 | S | | 2/1998 | Hollington |
| D391,119 | S | | 2/1998 | Rapaz |
| D393,910 | S | | 4/1998 | Chambers et al. |
| D394,513 | S | | 5/1998 | Davis |
| 5,807,096 | A | | 9/1998 | Shin et al. |
| D399,298 | S | | 10/1998 | Whitehead |
| 5,840,246 | A | | 11/1998 | Hammons et al. |
| 5,842,850 | A | | 12/1998 | Pappas |
| 5,843,194 | A | | 12/1998 | Spaulding |
| 5,871,553 | A | | 2/1999 | Spaulding |
| D410,756 | S | | 6/1999 | Kleinberg |
| 5,921,767 | A | | 7/1999 | Song |
| 5,927,959 | A | | 7/1999 | Johnson |
| 5,939,005 | A | | 8/1999 | Materna |
| 5,951,278 | A | | 9/1999 | Young et al. |
| 5,955,034 | A | | 9/1999 | Zaunbrecher et al. |
| 5,955,958 | A | | 9/1999 | Lu |
| 5,961,967 | A | | 10/1999 | Powell et al. |
| D416,099 | S | | 11/1999 | Hardy |
| D416,341 | S | | 11/1999 | Allen |
| 5,980,241 | A | | 11/1999 | Schirneker |
| 6,019,804 | A | | 2/2000 | Requejo et al. |
| 6,033,209 | A | | 3/2000 | Shin et al. |
| D422,180 | S | | 4/2000 | Sundberg |
| 6,050,812 | A | | 4/2000 | Chuang |
| D425,220 | S | | 5/2000 | Klett et al. |
| D425,636 | S | | 5/2000 | Freeman |
| 6,059,564 | A | | 5/2000 | Morris |
| 6,062,847 | A | | 5/2000 | Pappas |
| 6,068,472 | A | | 5/2000 | Freeman et al. |
| D426,902 | S | | 6/2000 | Hardy et al. |
| 6,074,199 | A | | 6/2000 | Song |
| 6,079,975 | A | | 6/2000 | Conover |
| 6,099,877 | A | | 8/2000 | Schuppan |
| D430,943 | S | | 9/2000 | Zutler |
| D433,168 | S | | 10/2000 | Cousins |
| 6,129,771 | A | | 10/2000 | Ficke et al. |
| 6,152,728 | A | | 11/2000 | Griffel |
| D435,100 | S | | 12/2000 | Pesu et al. |
| D436,415 | S | | 1/2001 | Hardy |
| 6,214,063 | B1 | | 4/2001 | DeStefano et al. |
| D443,080 | S | | 5/2001 | Klett et al. |
| D443,081 | S | | 5/2001 | Klett et al. |
| D443,082 | S | | 5/2001 | Klett et al. |
| D443,101 | S | | 5/2001 | Williamson |
| 6,231,336 | B1 | | 5/2001 | Chen |
| 6,241,362 | B1 | | 6/2001 | Morrison |
| 6,241,513 | B1 | | 6/2001 | Jeneral |
| D445,030 | S | | 7/2001 | Croft et al. |
| D445,337 | S | | 7/2001 | Croft et al. |
| 6,267,584 | B1 | | 7/2001 | Zou |
| 6,270,339 | B1 | | 8/2001 | Zou |
| 6,273,710 | B1 | | 8/2001 | Zou |
| 6,276,925 | B1 | | 8/2001 | Varga |
| D447,418 | S | | 9/2001 | Bezek et al. |
| 6,290,489 | B1 | | 9/2001 | Seidler |

| | | | | |
|---|---|---|---|---|
| D448,867 | S | 10/2001 | Manocheo et al. | |
| 6,296,477 | B1 | 10/2001 | Lin | |
| 6,299,435 | B1 | 10/2001 | Freeman et al. | |
| D450,395 | S | 11/2001 | Bellenger | |
| D450,865 | S | 11/2001 | Bellenger et al. | |
| 6,312,251 | B1 * | 11/2001 | Schmorleitz | 431/320 |
| 6,328,935 | B1 | 12/2001 | Buccellato | |
| 6,361,311 | B1 | 3/2002 | Smith | |
| D455,486 | S | 4/2002 | Makino | |
| D455,846 | S | 4/2002 | Araujo | |
| D456,539 | S | 4/2002 | Leeds | |
| 6,371,756 | B1 | 4/2002 | Toohey | |
| D459,498 | S | 6/2002 | Araujo | |
| 6,398,544 | B2 | 6/2002 | Wright et al. | |
| D461,916 | S | 8/2002 | Araujo | |
| D462,132 | S | 8/2002 | Papai | |
| 6,428,311 | B1 | 8/2002 | Bernardo | |
| 6,439,471 | B2 | 8/2002 | Ehrlich et al. | |
| D462,793 | S | 9/2002 | Freeman et al. | |
| 6,450,802 | B1 | 9/2002 | Steck | |
| 6,454,561 | B1 | 9/2002 | Colthar et al. | |
| D464,745 | S | 10/2002 | Mangini et al. | |
| 6,468,071 | B2 | 10/2002 | Zoy | |
| D465,587 | S | 11/2002 | Papai | |
| D466,236 | S | 11/2002 | Papai | |
| 6,488,494 | B2 | 12/2002 | Lee | |
| 6,491,516 | B1 | 12/2002 | Tal et al. | |
| D469,550 | S | 1/2003 | Moeller | |
| D469,893 | S | 2/2003 | Shen | |
| 6,520,770 | B2 | 2/2003 | Zou | |
| D471,299 | S | 3/2003 | Papai | |
| 6,531,063 | B1 | 3/2003 | Rose | |
| 6,537,063 | B1 | 3/2003 | Pecoskie | |
| 6,543,268 | B2 | 4/2003 | Wright et al. | |
| 6,544,302 | B2 | 4/2003 | Berger et al. | |
| 6,551,365 | B2 | 4/2003 | Berger et al. | |
| 6,554,448 | B2 | 4/2003 | Carpenter et al. | |
| D474,854 | S | 5/2003 | Lam | |
| 6,568,934 | B1 | 5/2003 | Butler | |
| 6,575,613 | B2 | 6/2003 | Brown et al. | |
| 6,579,089 | B1 | 6/2003 | Iu | |
| 6,592,637 | B2 | 7/2003 | McGee et al. | |
| 6,595,771 | B2 | 7/2003 | Chu | |
| 6,616,308 | B2 | 9/2003 | Jensen et al. | |
| D481,143 | S | 10/2003 | McMinn | |
| D481,473 | S | 10/2003 | Walsh | |
| 6,630,110 | B2 | 10/2003 | Urfig | |
| 6,648,631 | B2 | 11/2003 | Wright et al. | |
| D485,624 | S | 1/2004 | Kitamura | |
| 6,688,880 | B1 | 2/2004 | Pangle | |
| 6,695,611 | B2 * | 2/2004 | Lee | 431/293 |
| D487,687 | S | 3/2004 | Shields, Jr. | |
| 6,709,266 | B2 | 3/2004 | Jensen | |
| 6,730,137 | B2 | 5/2004 | Pesu et al. | |
| 6,733,279 | B2 | 5/2004 | Thigpen et al. | |
| D491,288 | S | 6/2004 | Young | |
| D493,548 | S | 7/2004 | Goldman | |
| D495,437 | S | 8/2004 | Barbera | |
| D495,438 | S | 8/2004 | Barbera et al. | |
| 6,769,905 | B2 | 8/2004 | Gray et al. | |
| 6,780,382 | B2 | 8/2004 | Furner | |
| D497,680 | S | 10/2004 | McMinn | |
| 6,802,707 | B2 * | 10/2004 | Furner et al. | 431/292 |
| 6,808,388 | B2 | 10/2004 | Lee | |
| 6,849,240 | B2 | 2/2005 | Nakatsu et al. | |
| 6,863,525 | B2 | 3/2005 | Byrd | |
| 6,923,639 | B2 | 8/2005 | Pesu et al. | |
| 2001/0031438 | A1 | 10/2001 | Hannington et al. | |
| 2002/0066789 | A1 | 6/2002 | Yen | |
| 2002/0068009 | A1 | 6/2002 | Laudamiel-Pellet | |
| 2002/0068010 | A1 | 6/2002 | Laudamiel-Pellet | |
| 2002/0093834 | A1 | 7/2002 | Yu | |
| 2002/0102187 | A1 | 8/2002 | Bellenger et al. | |
| 2002/0119413 | A1 | 8/2002 | Cheng | |
| 2002/0127507 | A1 | 9/2002 | Long | |
| 2003/0027091 | A1 | 2/2003 | Brandt | |
| 2003/0064336 | A1 | 4/2003 | Welch | |
| 2003/0134246 | A1 | 7/2003 | Gray et al. | |
| 2003/0162142 | A1 | 8/2003 | Bennetts et al. | |
| 2003/0175148 | A1 | 9/2003 | Kvietok | |
| 2004/0007787 | A1 | 1/2004 | Kvietok | |
| 2004/0009103 | A1 | 1/2004 | Westring | |
| 2004/0009447 | A1 | 1/2004 | Decker | |
| 2004/0016818 | A1 | 1/2004 | Murdell | |
| 2004/0028551 | A1 | 2/2004 | Kvietok | |
| 2004/0029061 | A1 | 2/2004 | Dibnah et al. | |
| 2004/0033171 | A1 | 2/2004 | Kvietok | |
| 2004/0033463 | A1 | 2/2004 | Pesu et al. | |
| 2004/0128879 | A1 | 7/2004 | Lu | |
| 2004/0160764 | A1 | 8/2004 | Lee | |
| 2004/0223871 | A1 | 11/2004 | Woo | |
| 2004/0223943 | A1 | 11/2004 | Woo | |
| 2004/0229180 | A1 | 11/2004 | Furner | |
| 2004/0241053 | A1 | 12/2004 | Thompson | |
| 2004/0265164 | A1 | 12/2004 | Woo | |
| 2005/0019238 | A1 | 1/2005 | Hart et al. | |
| 2005/0037306 | A1 | 2/2005 | Nakatsu | |
| 2005/0079463 | A1 | 4/2005 | Yu | |
| 2005/0239010 | A1 | 10/2005 | Duska et al. | |
| 2006/0057521 | A1 | 3/2006 | Kubicek et al. | |
| 2006/0057522 | A1 | 3/2006 | Kubicek et al. | |
| 2006/0057523 | A1 | 3/2006 | Kubicek et al. | |
| 2006/0057526 | A1 | 3/2006 | Kubicek et al. | |
| 2006/0057528 | A1 | 3/2006 | Kubicek et al. | |
| 2006/0057529 | A1 | 3/2006 | Kubicek et al. | |
| 2006/0084021 | A1 | 4/2006 | Kubicek | |
| 2006/0183065 | A1 | 8/2006 | Konkle, Jr. | |

FOREIGN PATENT DOCUMENTS

| | | |
|---|---|---|
| DE | 3302591 | 8/1984 |
| DE | 3403604 | 8/1985 |
| DE | 4203644 | 8/1993 |
| DE | 4241292 | 5/1994 |
| DE | 4314122 | 11/1994 |
| DE | 195 48 958 | 5/1996 |
| DE | 195 08 962 | 9/1996 |
| DE | 102004011919 | 6/2005 |
| EP | 0146247 | 6/1985 |
| EP | 1054054 | 11/2000 |
| EP | 1 336 799 | 8/2003 |
| EP | 1564485 | 8/2005 |
| FR | 2628825 | 3/1988 |
| GB | 161342 | 4/1921 |
| GB | 1514338 | 6/1978 |
| GB | 2 239 942 | 7/1991 |
| JP | 362220594 | 9/1987 |
| JP | 406212189 | 8/1994 |
| JP | 408185710 | 7/1996 |
| JP | 2003-213292 | 7/2003 |
| WO | WO 89/06141 | 7/1989 |
| WO | WO 95/12783 | 5/1995 |
| WO | WO 96/02794 | 2/1996 |
| WO | WO 99/17055 | 4/1999 |
| WO | WO 99/45322 | 9/1999 |
| WO | WO 01/46618 | 6/2001 |
| WO | WO 2004/008026 | 1/2004 |
| WO | WO 2004/083349 | 9/2004 |
| WO | WO 2004/083718 | 9/2004 |
| WO | WO 2004/090417 | 10/2004 |

OTHER PUBLICATIONS

Pourette Catalog 1998; p. 12.

Prices London Candlemakers; http:www.prices-candles.co.uk/mainpage.htm; 1 page, printed Apr. 21, 2005.

Prices London Candlemakers; http:www.prices-candles.co.uk/catalogue/Accessories/Accessories%20Page%2008.jpg; 1 page; printed Apr. 21, 2005.
Two (2) photos of Price's "Coral Bay Fragranced Bathroom" product taken Jan. 1, 1999.
Stephanie Reiser Wrought Iron—"Welcome to CourtingCandle.com!" http://www/courtingcandle.com; 1 page printed on May 12, 2004.
Intl. Search Report dated Oct. 13, 2006, Appl. No. PCT/US 2006/020218.
Intl. Search Report dated Jul. 27, 2006, Appl. No. PCT/US 2005/032266.
U.S. Appl. No. 09/742,631, Office Action dated Aug. 18, 2003.
U.S. Appl. No. 09/747,525, Office Action dated Sep. 9, 2003.
U.S. Appl. No. 09/747,525, Office Action dated May 20, 2003.
U.S. Appl. No. 09/747,525, Office Action dated Jan. 10, 2003.
U.S. Appl. No. 09/747,525, Office Action dated Jul. 2, 2002.
U.S. Appl. No. 09/747,525, Office Action dated Oct. 1, 2001.
U.S. Appl. No. 10/780,028, Office Action dated Oct. 4, 2006.
U.S. Appl. No. 10/780,028, Office Action dated Apr. 11, 2006.
U.S. Appl. No. 10/780,028, Office Action dated Oct. 18, 2005.
U.S. Appl. No. 10/938,434, Office Action dated Jul. 17, 2006.
U.S. Appl. No. 10/938,434, Office Action dated Nov. 20, 2006.
U.S. Appl. No. 10/978,744, Office Action dated Jul. 19, 2006.
U.S. Appl. No. 10/978,646, Office Action dated Aug. 3, 2006.
U.S. Appl. No. 10/978,744, Final Office Action dated Nov. 13, 2006.
U.S. Appl. No. 10/938,434, Final Office Action dated Nov. 20, 2006.
PCT Intl. Search Report and Written Opinion dated Dec. 5, 2006, Appl. No. PCT/US 2006/028220.
Intl. Search Report and Written Opinion dated Mar. 13, 2007, Appl. No. PCT/US2006/042787.
Intl. Search Report and Written Opinion dated Mar. 21, 2007, Appl. No. PCT/US2006/046057.
U.S. Appl. No. 11/123,372, Office Action dated Feb. 27, 2007.
U.S. Appl. No. 11/124,313, Office Action dated Feb. 28, 2007.
U.S. Appl. No. 11/123,461, Office Action dated Mar. 7, 2007.
U.S. Appl. No. 11/123,809, Office Action dated Mar. 7, 2007.
U.S. Appl. No. 10/978,646, Office Action dated May 4, 2007.
Office action dated May 4, 2007 for U.S. Appl. No. 10/978,646.

* cited by examiner

WICK-HOLDER ASSEMBLY

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to wick-holder assemblies, and more particularly to wick-holder assemblies responsive to thermal changes.

2. Description of the Background of the Invention

Candleholders frequently include assemblies to hold a fuel charge that has a wick holder to retain a wick within the fuel charge. One such candleholder has a plurality of decorative radial arms extending upward from a candle support cup that holds a fuel charge. In such a candleholder, the radial arms are circumferentially spaced around the candle support cup. Each arm includes an inwardly turned tip portion that is directed toward a candle placed in the candle support cup.

Another candleholder is a candlestick in which a cylindrical candle is retained at a bottom end thereof by a metallic spring clasp secured on a saucer portion. A wick is retained in the cylindrical candle. The spring clasp is coined from a sheet of metal to have a pair of opposing resilient arms extending upward from a base section. Upper tip portions of the arms are curved outwardly. The arms are angled inwardly to resiliently clasp the bottom end of the candle therebetween. A lug on the saucer portion interlocks with a complementary lug on the base section to retain the spring clasp thereon.

A candle having a thermal response has a wick holder disposed on an upper end of a support column that extends downwardly through a wax fuel element. Each of a first and second bimetallic coil is secured in a horizontal position to the support column at a radial inner end thereof. The bimetallic coils are disposed in a wax melt pool. An arm extends upward from the radial outer end of each bimetallic coil, and a partial heart shaped medallion extends upward from each arm. The bimetallic coils move the heart shaped medallions together tangentially around the support column when the wax melt pool is heated by a flame on the wick due to differential thermal expansion of the bi-metallic coils.

Another candleholder includes a conically shaped metallic dish, a metallic wick clip, and a wick, all of which are placed on top of a wax fuel element. The wick is carried within the wick clip, and the wick clip is retained in a hole through the dish such that an upper portion of the wick extends above the dish and a lower portion of the wick extends below the dish. A plurality of upturned petals is disposed around the periphery of the dish and partially surrounds the wick and a flame on the wick. A metal wire extends through a central axis of the wick, and an exterior helical coil of wire extends along the exterior length of the wick. A metal decorative element is carried over the dish and extends proximate the flame. Heat from the flame is conducted by convection and by conduction through the wires, the decorative element, and the wick clip to form a pool of molten wax centrally disposed on the top of the wax fuel element under the dish and wick. The dish, wick clip, and wick move down with the top of the fuel element as the flame consumes the molten wax.

SUMMARY OF THE INVENTION

According to one aspect of the invention, a wick-holder assembly includes a wick-retention member for retaining a wick in an operative position extending from a base portion and a heat-conductive element extending from the base portion. A portion of the heat-conductive element is arranged to cause the heat-conductive element to move substantially radially toward or away from the wick-retention member in response to a flame disposed on the wick.

According to another aspect of the invention, a wick-holder assembly includes a wick-retention member for retaining a wick in an operative position that extends upward from a base portion, a heat-conductive element extending upward from the base portion, and a leg that extends from the base portion. The heat-conductive element includes at least two materials having different thermal expansion coefficients. The base portion is substantially stationary relative to the wick-retention member.

According to another aspect of the invention, a wick-holder assembly includes a wick-retention member for retaining a wick thereto, a heat-conductive element that includes at least two materials having different thermal expansion coefficients, and a substantially stationary base portion extending from the wick-retention member to the heat conductive element.

Other aspects of the present invention will become apparent upon consideration of the following detailed description.

DETAILED DESCRIPTION

Figure 1:
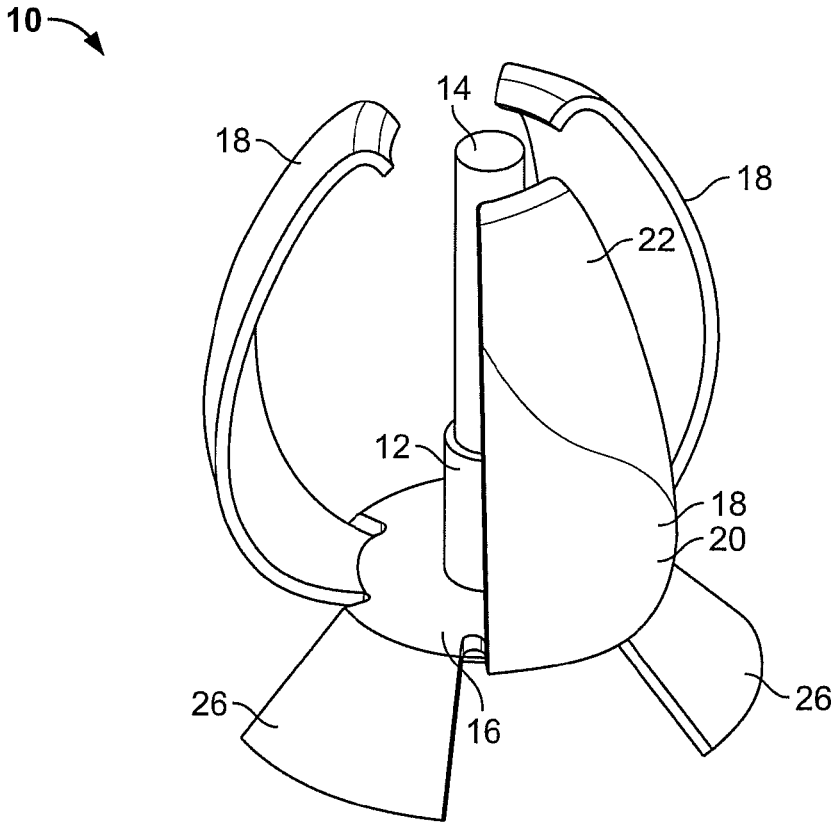
FIG. 1 is an isometric view of a wick-holder assembly according to an embodiment of the invention.

Turning now to the figures, FIGS. 1-4 show a wick-holder assembly 10 that includes a wick-retention member 12 for retaining a consumable or non-consumable wick 14, heat-conductive elements 18 extending upward from a base portion 16, and legs 26 extending downward from the base portion. The wick-retention member 12 extends upward from the base portion 16 to retain the wick 14 in an operative position. In other embodiments not shown, the wick-retention member 12 is integral to and/or formed from one or more elements of the wick-holder assembly 10, such as, for example one or more heat-conductive elements 18. The heat-conductive elements 18 may include a number of portions, including, for example, a first portion 20 and a second portion 22 that assist in moving the heat-conductive elements in response to thermal changes. A capillary rib 24 is disposed underneath and extending from the base portion 16.

One or more portions of the heat-conductive elements 18, including the first portion 20 and the second portion 22, may be constructed of various materials having different thermal expansion coefficients that respond to thermal changes and facilitate movement of the heat-conductive element toward or away from a flame and as shown by an arrow A. Examples of a material useful in the present invention include a metal, such as aluminum, steel, nickel, magnesium, copper, iron, silver, zinc, tin, or titanium, a polyester, and a ceramic, and mixtures and combinations thereof, such as bronze, brass, copper and aluminum, and/or a copper-plated ceramic. Additionally, one or more heat-conductive elements 18 may be made of the same material or different materials. For example, one or more heat-conductive elements 18 may be constructed of a single material such as aluminum, steel, or copper, while one or more other heat-conductive elements may be constructed from two or more materials such as a bimetallic material such as copper and aluminum, or a composite or bi-material such as polyester and aluminum or a plated ceramic material such as a metal-plated ceramic including, for example, copper plated ceramic. The other components of the wick-holder assembly 10 such as the wick-retention member 12, the base portion 16, the capillary ribs 24, and/or the legs 26 may also be made of the same material as the one or more of the heat-conductive elements 18 and in one embodiment at least one of the heat-conductive elements, the base portion, the capillary ribs, or the legs is a bimetallic material such as copper and aluminum.

Figure 2:
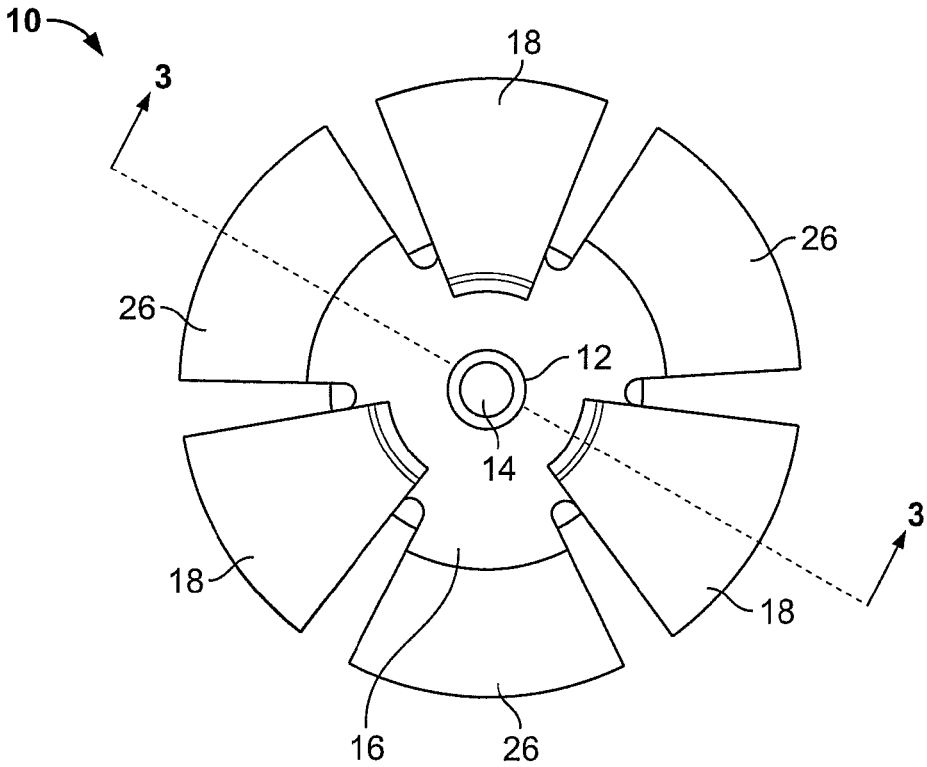
FIG. 2 is a plan view of the wick-holder assembly shown in FIG. 1.
Figure 3:
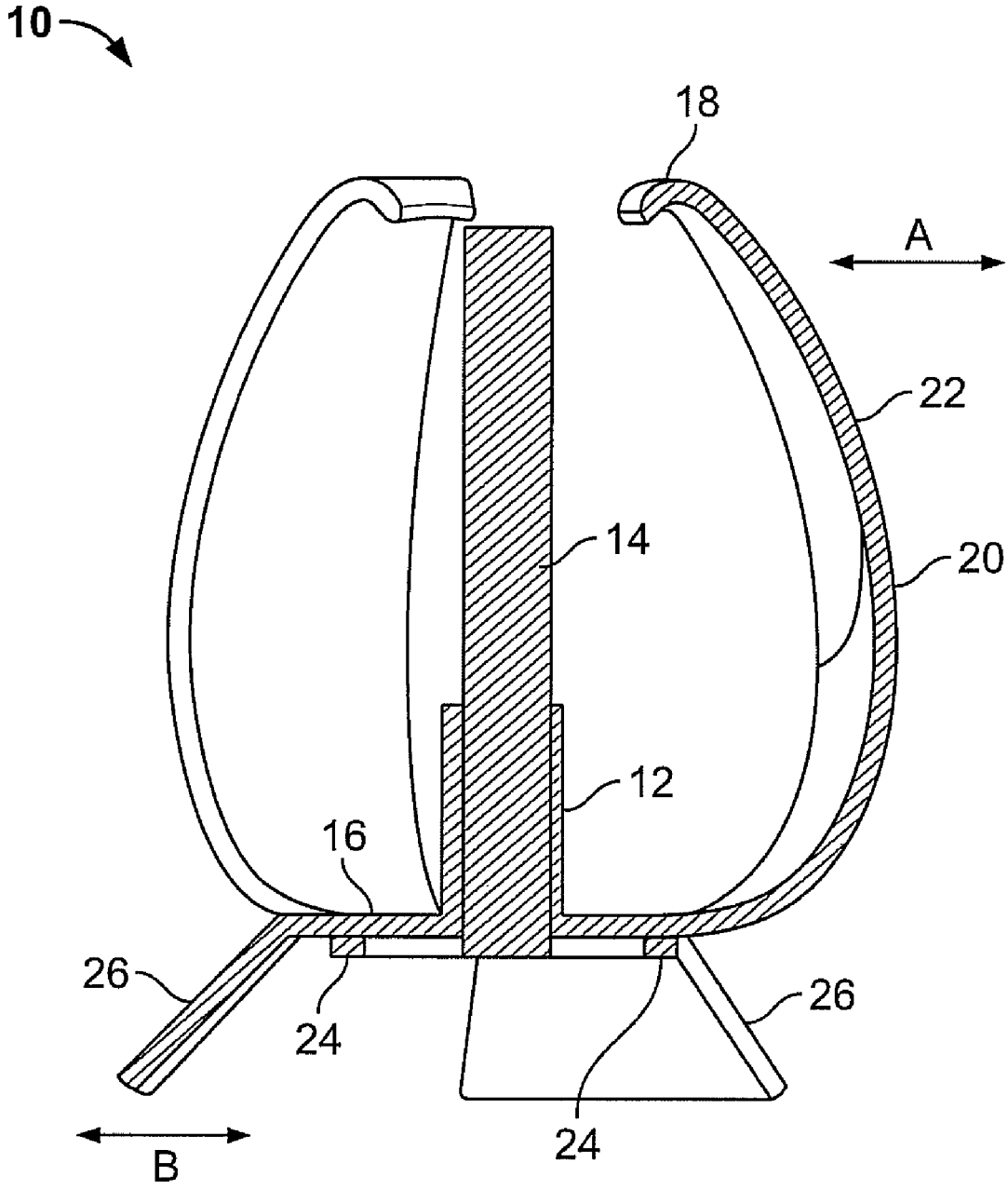
FIG. 3 is a partial cross-sectional view generally along the lines 3-3 of FIG. 2 of the wick-holder assembly shown in FIG. 1.
Figure 4:
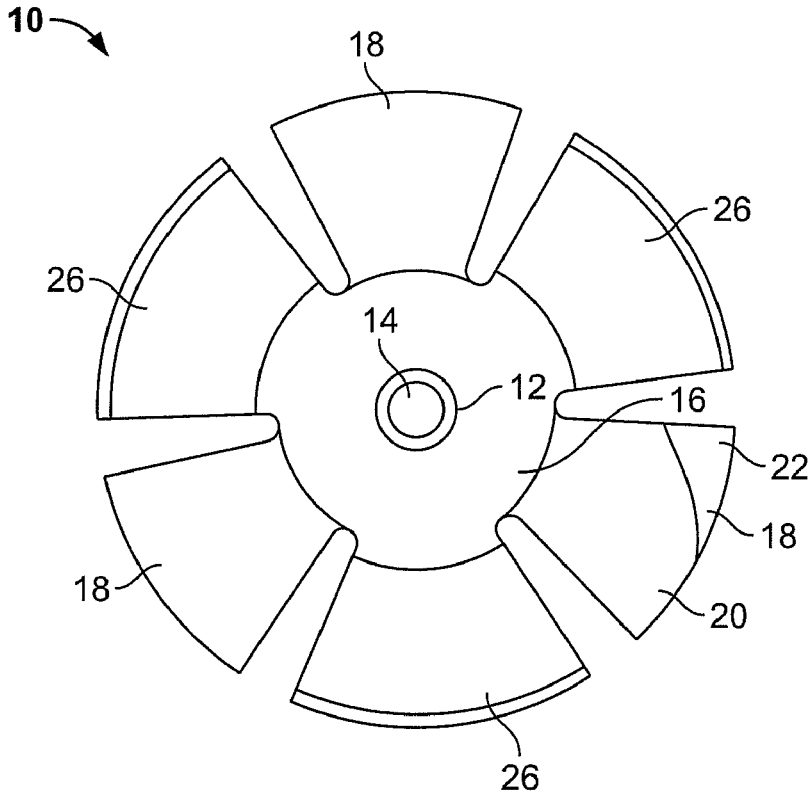
FIG. 4 is a bottom plan view of the wick-holder assembly shown in FIG. 1.

In one embodiment of the present invention, the wick-retention member 12 is configured to retain a consumable or non-consumable wick 14. In yet another embodiment, the wick-retention member 12 is a non-consumable or reusable wick that is configured to burn a fuel charge via capillary action. As shown in FIGS. 1-3, the wick 14 extends vertically from the wick-retention member 12 and through the base portion 16 into a capillary space (not shown) defined by a support surface (not shown) that holds the wick-holder assembly and the capillary ribs 24, the base portion 16, and the legs 26 of the wick-holder assembly 10.

In one embodiment of the present invention, the first portion 20 and the second portion 22 are constructed and arranged to move toward or away from a heat source such as a flame (60, FIG. 6) disposed on the wick 14. Movement of one or more portions 20, 22 of the heat-conductive element 18 can independently be in any direction including, for example, upward, downward, sideways, axially, spirally, and/or directly radially from, for example, the wick-retention member 12, and depends in one embodiment on the configuration and/or the amount of thermal expansion coefficient difference of the material used to construct the heat-conductive element. Moreover, movement of the heat-conductive element 18 may be influenced by the location and placement of the materials having different thermal expansion coefficients within the heat-conductive element. The shape, the location, and/or the distance of the heat-conductive element 18 from the heat source may also influence the movement of the heat-conductive element.

Figure 6:
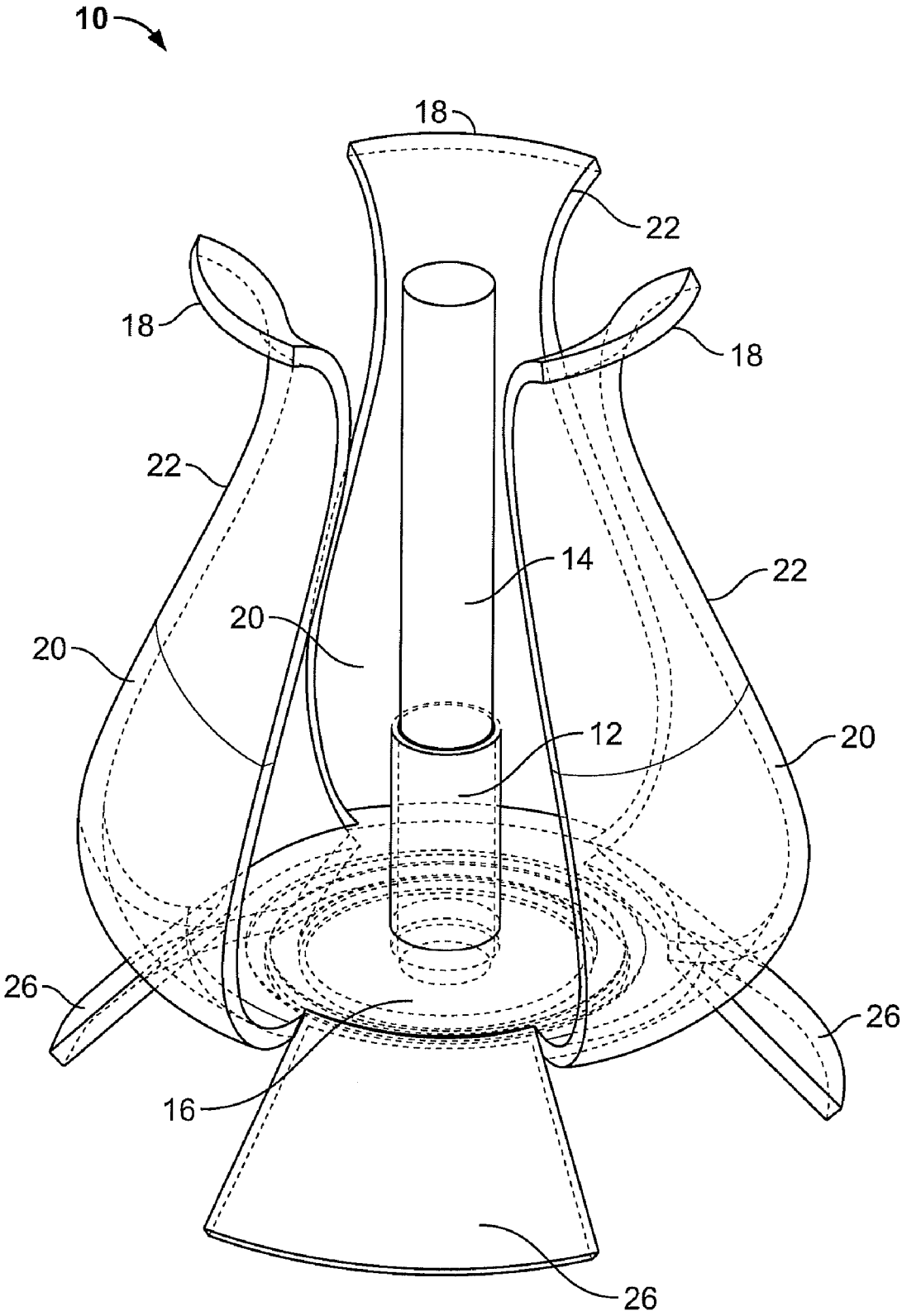
FIG. 6 is an isometric view of a wick-holder assembly according to another embodiment of the invention.

The wick-holder assembly 10 may be disposed on any appropriate apparatus that is adapted to hold a fuel charge in conjunction with the wick-holder assembly of the present invention, such as the melting plate assembly 50 shown in FIG. 6. The melting plate assembly 50 includes a fuel charge (not shown), such as meltable candle wax or liquid oil, and a melting plate 52 supported by a base member 56. The base member 56 may take any desired form suitable for supporting the melting plate 52. The melting plate 52 includes a capillary lobe 58 centrally disposed therein. In one embodiment of the present invention, when the wick-holder assembly 10 is operatively disposed on the melting plate assembly 50, the capillary rib 24 of the wick-holder assembly rests on the capillary lobe 58 to create a capillary space (not shown) between the wick-holder assembly and the capillary lobe 58. The capillary space extends between the melting plate 52 and the wick-holder assembly 10 and generally includes the area between the capillary lobe 58 and the capillary rib 24, the legs 26, and/or the base portion 16. The capillary space allows melted or liquid fuel to be drawn between the wick-holder assembly 10 and the melting plate 52 toward the wick 14 to feed the flame 60 disposed on the wick-retention member 12. Illustratively, heat from the flame 60 on the wick 14 melts the fuel charge by direct convection and/or conduction through the heat-conductive elements 18 and conduction to the melting plate 52 to form a pool of liquid fuel (not shown), such as melted candle wax, adjacent to the capillary lobe 58. The liquid fuel is drawn through the capillary space by capillary action to the wick 14 to feed the flame 60. The wick-holder assembly 10 may be used to maintain the wick 14 in an operative position after the fuel charge has been substantially melted. In one embodiment, a volatile active, such as a fragrance and/or an insect repellant, for example, is carried by the fuel element for dispersion to the surrounding environment when the fuel element is burned. The wick-holder assembly 10 may also be secured to the melting plate assembly 50 by any appropriate method know to those skilled in the art, including, for example, a magnet, an adhesive, a rivet, a tape, or a weld, and combinations thereof. Additional details and aspects of a melting plate candle assembly are described in U.S. patent application Ser. No. 11/123,372, which is incorporated herein by reference in the entirety thereof.

In other embodiments, the geometry of the heat-conductive element 18 is such that the heat-conductive element substantially surrounds or partly surrounds the wick-retention member 12 and, therefore, the flame 60 supported by the fuel charge. For example, the wick-holder assembly 10 shown in FIG. 5, has heat-conductive elements 18 that are generally S-shaped as opposed to a generally convex-shape of the heat-conductive elements shown in FIGS. 1-4.

Figure 5:
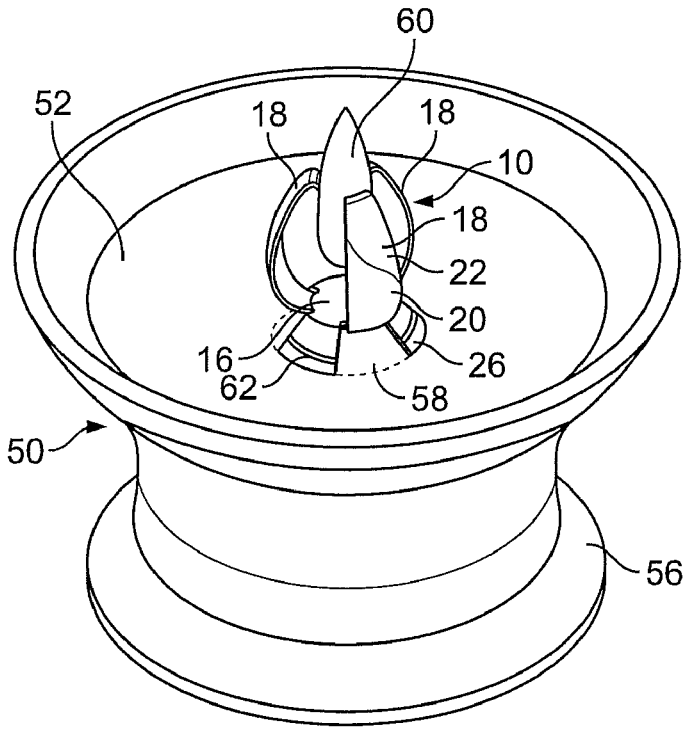
FIG. 5 is an isometric view of the wick-holder assembly of FIG. 1 disposed on melting plate candle assembly in an operative position.

In operation, the geometry and/or the composition of one or more components of the wick-holder assembly 10 may be configured to control and/or regulate the temperature of the wick-holder assembly, the capillary space between the wick-holder assembly and a support surface holding the wick-holder assembly such as the melting plate 53 of FIG. 5, and/or the movement of air surrounding a heat source such as the flame 60 disposed on the wick-holder assembly. The geometry of a component generally relates to, for example, the positioning of the component on the wick-holder assembly 10, the movement of the component on the wick-holder assembly in response to heat generated from a flame 60 disposed on the wick 14, the size and/or shape of the component, and/or the thickness of the component.

In one embodiment, the temperature of the wick-holder assembly 10 is controlled and/or regulated, by the shape and/or the positioning of the heat-conductive elements 18. For example, to increase the temperature of the wick-holder assembly 10 while the flame 60 is lit, the heat-conductive elements 18 are shaped and/or positioned to be closer to the flame and/or to expose more surface area to the flame. The closer to the flame 60 and/or the more surface area that is exposed to the flame, the more heat is transferred from the flame to the heat-conductive elements 18. From the heat-conductive elements 18, heat is then transferred to the other components of the wick-holder assembly 10. The heat of the wick-holder assembly 10 may then be transferred to the fuel charge, which facilitates melting and/or volatilization thereof. The composition of the various components may also be selected to control and/or regulate the temperature of the wick-holder assembly 10. For example, the heat-conductive elements 18 can be made of various materials having different thermal conductivity and/or thermal expansion coefficients such as a multi-metallic material, for example, a bi-metal, which when heated a surface is configured to move toward or away from the heat source. The materials may be positioned within and/or on the heat-conductive elements 18 at various locations, for example, within and/or on the first portion 20 or the second portion 22, to facilitate heat transfer and/or movement of the heat-conductive elements toward or away from the flame 60.

In other embodiments, the capillary space between the wick-holder assembly 10 and the melting plate assembly 50 is controlled and/or regulated by the geometry and/or the composition of one or more components of the wick-holder assembly. For example, in one embodiment when one or more legs 26 and/or capillary ribs 24 are heated, one or more dimensions, for example, a length, width, and/or height, of the legs and/or capillary ribs are configured to move in a direction that increases and/or decreases the capillary space of the wick-holder assembly 10. Illustratively, after the wick 14 or the wick-retention member 12 is lit and begins to generate heat, one or more dimensions of the legs 26 and/or the capillary rib 24 increases in response to the heat. The increased dimension in one embodiment reduces the capillary space and thereby restricts flow rate of the liquid fuel charge disposed in and/or traveling through the capillary space. Additionally, or alternatively, as the flame 60 begins to produce less heat and the legs 26 and/or the capillary ribs 24 begin to cool, the one or more dimensions of the legs 26 and/or the capillary ribs 24 begin to decrease, thereby allowing more fuel to pass through the capillary space. By regulating the flow rate of the fuel charge, the size and/or the burn rate of the flame 60 may be regulated by changing the amount of fuel supplied to the flame.

Furthermore, by reducing the impact of breezes and other movements of air surrounding the flame 60, the thermal output of the flame may be maintained or enhanced in comparison to a flame without the protection of the heat-conductive element 18. In one embodiment, by maintaining or enhancing flame performance, thermal generation can be increased and/or optimized to melt and/or volatilize a fuel charge.

Changing geometry of one or more components of the wick-holder assembly 10 via a thermal response may also be used to engage, interlock and/or secure the wick-holder assembly to an apparatus such as the melting plate assembly 50 shown in FIG. 6. For example, the legs 26 may be configured to move in a direction of arrow B by the use of differing expansion properties of a bi-metal, for example, as the wick-holder assembly warms and cools. Illustratively, after the wick 14 is lit, the heat-conductive elements 18 begin to warm and heat is transferred to the base portion 16 and to the legs 26. As the legs 26 begin to warm, different portions of the legs begin to expand at different rates correlated to the material in which the legs are composed. In one embodiment, the legs, 26 begin to move in a direction toward the capillary lobe 58 and engage or grip a groove (not shown) in the melting plate 52. When the flame is extinguished and the wick-holder 10 cools, the legs 26 contract and return to an original position. In this embodiment, the use of other attachment methods such as a magnet to secure the wick-holder assembly 10 to the melting plate 52 may not be necessary.

The wick-retention member 12 in one embodiment is made of a heat-transmissive material, such as a metal, which facilitates conductive heat transfer from the flame 60 to the melting plate 52. In the embodiment shown in FIG. 3, the wick-retention member 12 is attached to the base portion 16 that includes one or more capillary ribs 24 and/or capillary channels (not shown). The shape of the capillary rib 24 shown is a raised rib extending partly around the base portion 16 and is a length, width, and/or height that facilitates capillary action of the melted and/or liquid fuel charge while the flame 60 is lit. Additionally, or alternatively, the capillary lobe 58 may have capillary ribs and/or capillary channels (both not shown) of a shape and/or dimension to assist in the capillary movement of the melted or liquid fuel charge to the flame 60. Any other shape and/or dimension of the capillary ribs 24 and/or the capillary channels is also contemplated as long as a capillary space may be created to facilitate movement of the melted or liquid fuel charge.

In another embodiment, the base portion 16 does not include the capillary ribs 24 and/or the capillary channels, but may be located instead on a member of the support apparatus such as the capillary lobe 58 that holds the wick-holder assembly 10.

It is also contemplated that where the wick-holder assembly 10 has a plurality of components, members, and/or elements, for example, two of more wick-retention members 12, wicks 14, base portions 16, heat-conductive elements 18, capillary ribs 24, and/or legs 26, each component, member and/or element may be independently selected and configured in regard to positioning, geometry and/or composition to achieve a desired effect such as flame intensity, burn time of the fuel charge, and/or volatilization rate of a fragrance, insecticide, and the like. It is further contemplated that the wick-holder assembly 10 may have one or more components, members, and/or elements that are configured to perform one or more similar functions. In such a case, the wick-holder assembly 10 may in some embodiments be constructed to be without the component, member, and/or element whose function is being performed by another component, member, and/or element. Illustratively, the heat-conductive elements 18 may be configured to be connected directly to the wick-retention member 12, thus serving one or more functions of the base portion 16 as described herein. In such an embodiment, the wick-holding assembly 10 may be constructed without the base portion 16 inasmuch as the heat-conductive element 18 is serving the function of the base portion.

INDUSTRIAL APPLICABILITY

The present invention provides a user with a wick-holder assembly that is responsive to thermal changes of a flame disposed on a wick. The wick-holder assembly may also speed melting of a fuel charge by moving heat-conductive elements toward the flame and enhancing heat transfer from the flame to the fuel charge. The wick-holder assembly may also surround the flame, which reduces the impact of breezes on the flame, therefore reducing the chances of the breeze extinguishing the flame.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications within the scope of the impending claims are reserved.

We claim:

1. A wick-holder assembly, comprising:

a wick-retention member for retaining a wick in an operative position extending from a base portion; and a heat-conductive element extending from the base portion, wherein the heat-conductive element comprises a first portion made substantially of a first material and a second portion made substantially of a second material, the first material and second material comprise materials of different thermal expansion coefficients, and a portion of the heat-conductive element is arranged to move in response to a flame disposed on the wick;

wherein the base portion is adapted to be disposed on a support surface therefor such that a capillary space is formed therebetween that extends to the wick, and wherein the movement of the heat-conductive element in response to the heat generated by the flame affects a dimension of the capillary space and thereby regulates flow of a fuel through the capillary space to the wick.

2. The wick-holder assembly of claim 1, wherein the first material and second material comprise at least one material selected from the group consisting of a metal, a ceramic, and a polyester.

3. The wick-holder assembly of claim 2, wherein the metal comprises at least one metal selected from the group consisting of aluminum, steel, nickel, magnesium, copper, iron, silver, zinc, tin, and titanium.

4. The wick-holder assembly of claim 1, wherein the heat-conductive element moves radially toward or away from the wick-retention member in response to heat generated by the flame.

5. The wick-holder assembly of claim 1, wherein the base portion further comprises a capillary rib extending therefrom.

6. The wick-holder assembly of claim 1, wherein the dimension of the capillary space comprises at least one of a length, a width, and a height.

* * * * *